US005385165A

United States Patent [19]

Hazinski et al.

[11] Patent Number: 5,385,165

[45] Date of Patent: Jan. 31, 1995

[54] HUNTING BLIND

[76] Inventors: Daniel P. Hazinski, 4481 SW. 34th Ter., Ft. Lauderdale, Fla. 33312; Sidney Samole, 6755 SW. 152nd St., Miami, Fla. 33157

[21] Appl. No.: 191,365

[22] Filed: Feb. 3, 1965

[51] Int. Cl.[6] ..... E04H 15/40

[52] U.S. Cl. ..... 135/126; 135/905; 135/115

[58] Field of Search ..... 135/104, 106, 109, 115, 135/117, 119, 905, 901

[56] References Cited

U.S. PATENT DOCUMENTS 2,442,132 5/1948 Laylhe ..... 135/119 X
3,103,050 9/1963 Reitmeier ..... 135/119 X
3,800,814 4/1974 Hibbert ..... 135/119 X
5,249,592 10/1993 Springer et al. ..... 135/905 X

*Primary Examiner*—Carl D. Friedman
*Assistant Examiner*—Lan C. Mai

[57] ABSTRACT

A self erecting hunting blind is provided with a quick release opening. A self erecting structure is formed having a first lower loop and a second upper loop arranged transverse to the lower loop. The fabric covering the upper transverse loop is divided into longitudinal halves which are releasably held together by a quick release apparatus. Upon releasing the quick release, the transverse loop halves move away from each other and fold flat against the ground completely uncovering a hunter within the blind. The blind may be used on the ground or over a boat.

10 Claims, 3 Drawing Sheets

HUNTING BLIND

BACKGROUND

This invention relates in general to the field of portable outdoor enclosures and in particular to the field of self erecting enclosures functioning as a duck hunting blind having an integral frame with attached fabric covering and arranged to rapidly open.

PRIOR ART

The prior art in the field of self erecting tent structures relevant to the present invention is perhaps best exemplified in the use of a single continuous rod or wire to form the supporting frame. The resulting tent having two loop-like substructures crossing each other at a right angle whereby one loop forms the tent floor and the other forms the tent roof and walls. The spring supplies the forces needed to form the tent fabric into a tent structure. The self erecting feature of the tent being such that when thrown up into the air the tent transforms from a circular shape to that of a fully formed tent when it settles onto the ground.

In the above described prior art, a relatively weather proof enclosure is effectuated which is readily erected and folded. While such tents are completely adequate for sleeping purposes, the same is not readily used as a blind for example, when hunting ducks. The integral zippered opening for gaining ingress and egress to the tent must first be zippered open. This of course takes a certain amount of time and is relatively inconvenient for a hunter who is equipped with a long shotgun. The hunter must put the gun down, unzipper the opening, pick up the gun, step through the opening, aim the gun and then fire. By this time, the ducks may be so far away that there is no chance for a clean shot. Then too, there is the aspect of safety. Since the gun must be loaded, it is undesirable to put down, pick up and step through an opening with a loaded gun.

Accordingly, it is a primary object of the present invention to provide a self erecting, pop-up enclosure for use as a duck blind which is readily opened by a hunter immediately prior to taking aim with for example, a shotgun.

Another object of the present invention is to provide a self erecting duck blind which is extremely portable and having a folded configuration allowing for such portability.

Another object of the present invention is to provide a duck blind which is not observable by passing overhead ducks and yet allows a hunter to be able to see passing overhead ducks.

Another object of the present invention is to provide a self erecting duck blind which is adaptable for use on land or a boat.

Another object of the present invention is to provide a self erecting duck blind which can also be used to shelter a hunter from inclimate weather.

SUMMARY OF THE INVENTION

The present invention accomplishes the above stated objectives, as well as others, as may be determined by a fair reading and interpretation of the specification herein including the drawings, abstract and claims appended thereto.

A single rod or wire is arranged and connected by a single connector and together with attached fabric forms a self erecting, pop-up, rapidly opening duck blind. The base enclosure includes a lower loop which may be placed on the ground or over a boat. An upper loop is arranged transverse to the lower loop. A rod having spring-like characteristics is fitted to a substantially continuous sleeve provided in the tent fabric, which sleeve is configured in accordance with the lower and transverse loops.

A slit opening is provided in the fabric along the length of the transverse loop at the approximate center thereof thereby dividing the transverse loop into two halves. A sleeve is formed on each side of the fabric along the length of the slit opening. A rod is fitted within each of the sleeves along the slit opening which rods take on the curved configuration of the sleeves along the longitudinal length of the slit opening in the transverse loop when the enclosure is erected. A strap, having a quick disconnect buckle, is attached at each end thereof to halves of the transverse loop. Upon disengaging the quick disconnect buckle, each half of the transverse loop rapidly falls away from the other causing the entire blind structure to lie flat on the ground fully exposing the hunter therein.

BRIEF DESCRIPTION OF THE DRAWINGS

Various other objects, advantages and features of the invention will become apparent to those skilled in the art from the following discussion taken in conjunction with the following drawings, in which.

DETAILED DESCRIPTION OF THE PREFERRED EMBODIMENTS

Figure 1:
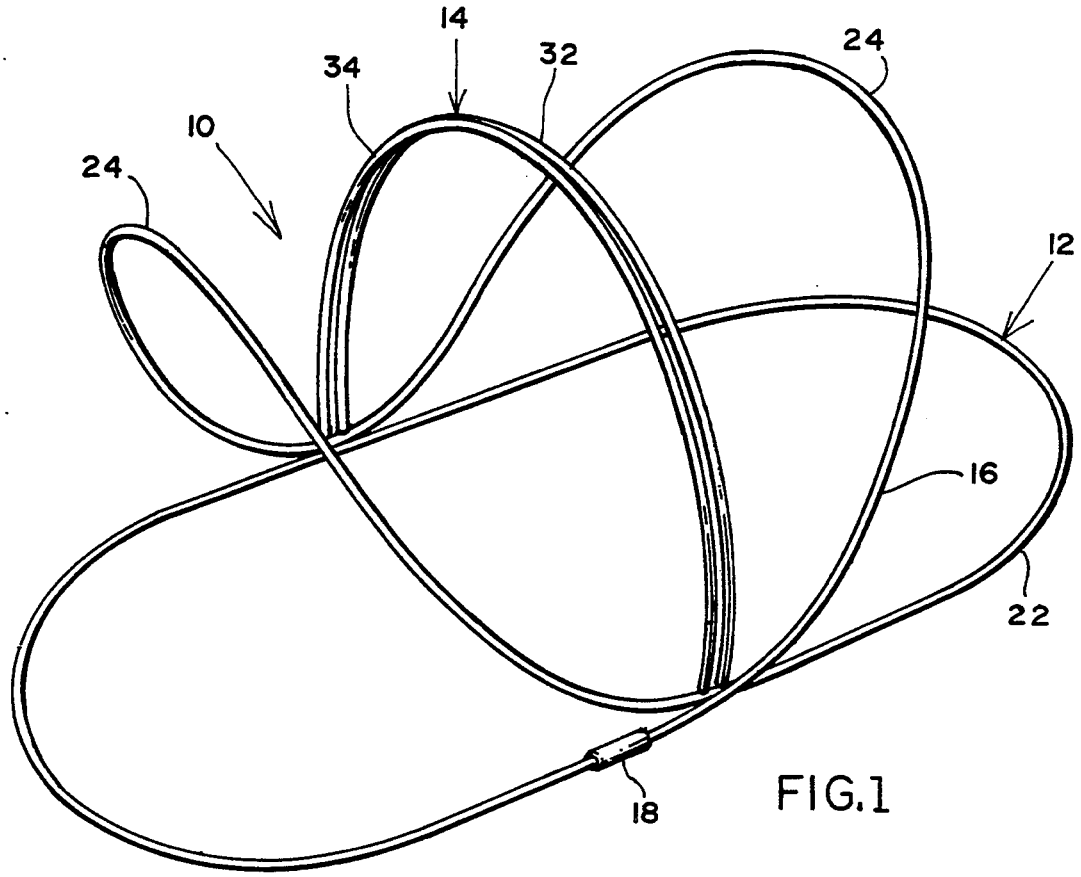
FIG. 1 is an isometric view of the frame of the inventive duck blind.

As required, detailed embodiments of the present invention are disclosed herein; however, it is to be understood that the disclosed embodiments are merely exemplary of the invention which may be embodied in various forms. Therefore, specific structural and functional detail disclosed herein are not to be interpreted as limiting, but merely as a basis for the claims and as a representative basis for teaching one skilled in the art to variously employ the present invention in virtually any appropriately detailed structure.

Reference is now made to the various figures of the drawings, wherein like characteristics and features of the present invention shown on the various figures are designated by the same reference numerals.

FIG. 1 shows, in perspective, the rod or wire frame of the pop-up blind hunting structure 10 illustrating the base, self erecting, single rod, frame 12 together with the additional frame 14 forming the rapidly opening hunting blind portion when the rod frame is fitted to tent fabric and when the blind structure 10 is in an erected mode. The base portion 12 may comprise a single rod or wire 16 which may be made from any appropriate material having a spring like characteristic such as metal wire, fiberglass or the like, joined at its ends by a single connector 18 forming an endless loop structure having a first lower loop 22 and a second upper loop 24. For purposes of this description the lower loop 22 is sometimes referred to as the ground loop and the upper loop 24 is sometimes referred to as the transverse loop. Thus, the ground loop 22 is intended to lie flat against the ground where the blind is placed. The transverse loop 24 forms the height structure which provides the blind 10 with its vertical height and shape.

Figure 3:
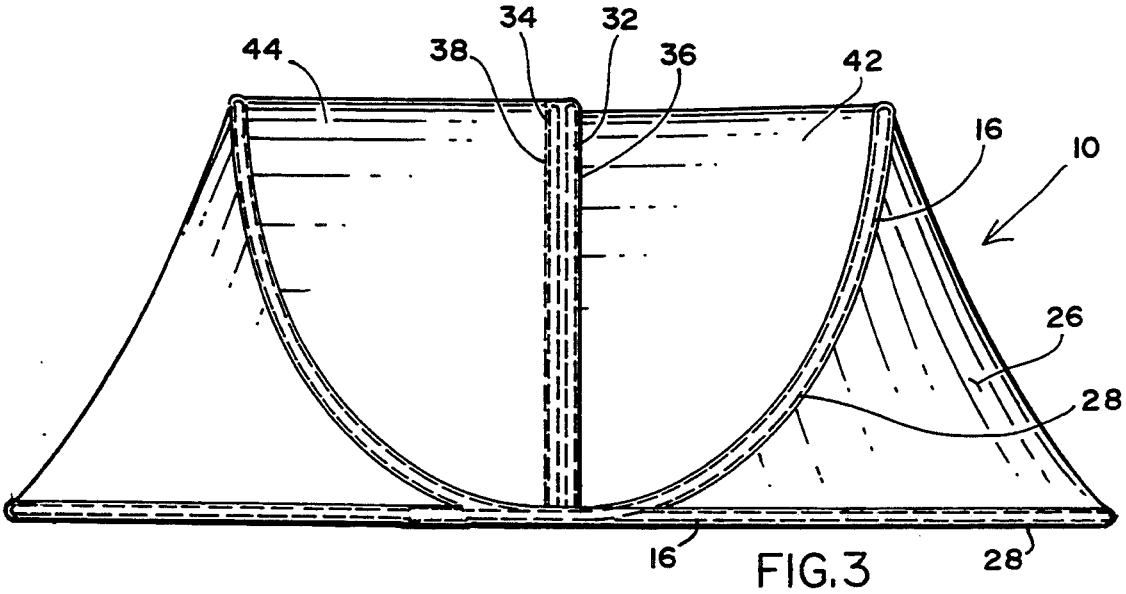
FIG. 3 is a side view of an erected duck blind showing the fabric attached to the frame.

As seen in FIG. 3, blind fabric 26 is fitted to the ground 22 and transverse 24 loops and forms the protective fabric shell of the blind 10. A substantially continuous sleeve 28 following the shape of the loops 22 and 24 as shown in FIG. 1 is provided in the blind fabric 26. Thus, the combination of the spring tension in rod 16 and the constraining configuration of sleeve 28 forms the blind 10 into the taut, self erecting and standing shape shown in FIG. 3.

Referring again to FIG. 1, a first rod 32 extends between the front portion of the transverse loop 22 to the back portion thereof. A second rod 34 similarly extends between the front and back portion of transverse loop 22 and is substantially parallel to the first rod 32. In FIG. 3, it is seen that rods 32 and 34 fit within sleeves 36 and 38, respectively, in tent fabric 26. Since sleeves 36 and 38 and 38 retain rods 32 34 and 16 in position according to the configuration of blind 10, there is no need to provide a hinge at the juncture of rods 32 and 34 with rod 16. In actuality, the blind fabric 26 at the juncture locations provide the hinging function.

Figure 2:
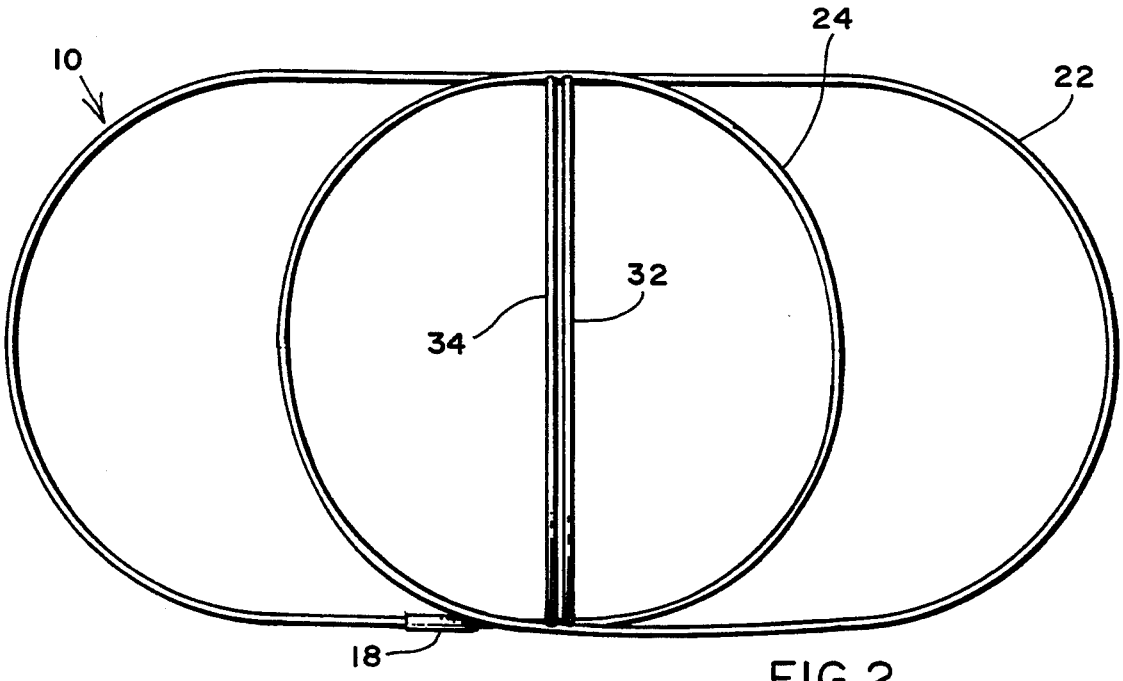
FIG. 2 is a top plan view of the frame of FIG. 1.

The frame structure shown in FIG. 2 provides a top view of the configuration of ground loop 22 and transverse loop 24. The center location of rods 32 and 34 along transverse loop 24 is also shown.

FIG. 3 shows blind 10 in a fully erected mode when the same is self erected by simply throwing the blind into the air and allowing it come to rest on the ground. The blind fabric 26 at the location of the transverse loop 24 may be considered as being slit along the line of rods 32 and 34 or may be considered as being divided into two substantially identical haves 42 and 44. As previously stated, a sleeve opening is provided at each end of each half 42 and 44. Rod 32 is positioned within sleeve 36; rod 34 is positioned with sleeve 38, but, the overlapping is not essential to the invention. The existence of slight gap between sleeves 36 and 38 is not consequential.

Figure 4:
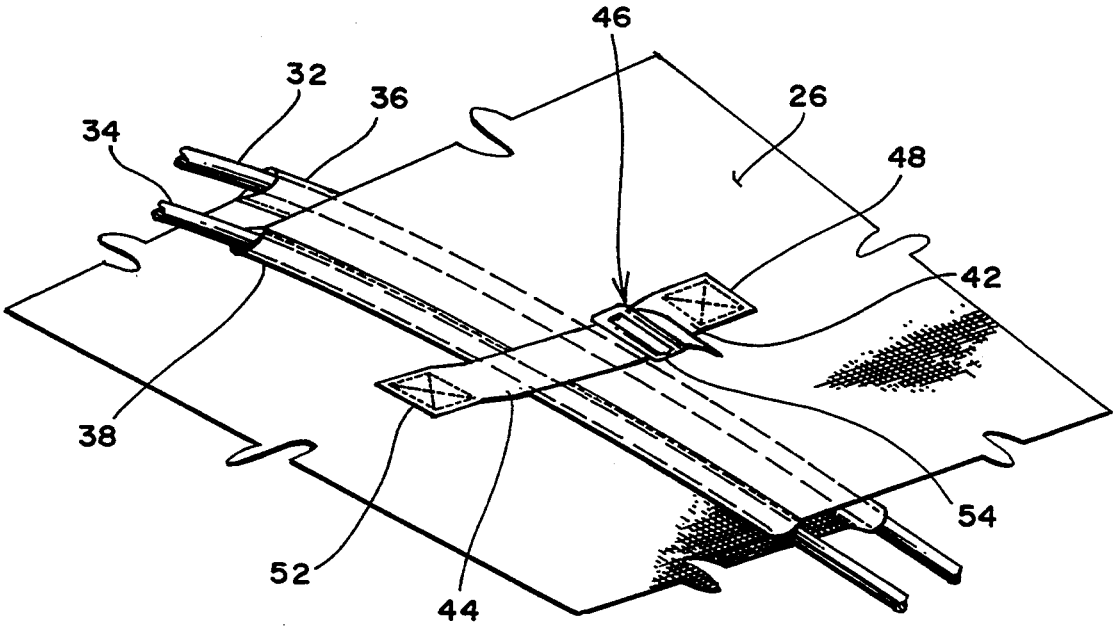
FIG. 4 is an isometric view of a portion of the transverse loop halves showing the attachment thereto of a quick disconnect buckle and strap.
Figure 5:
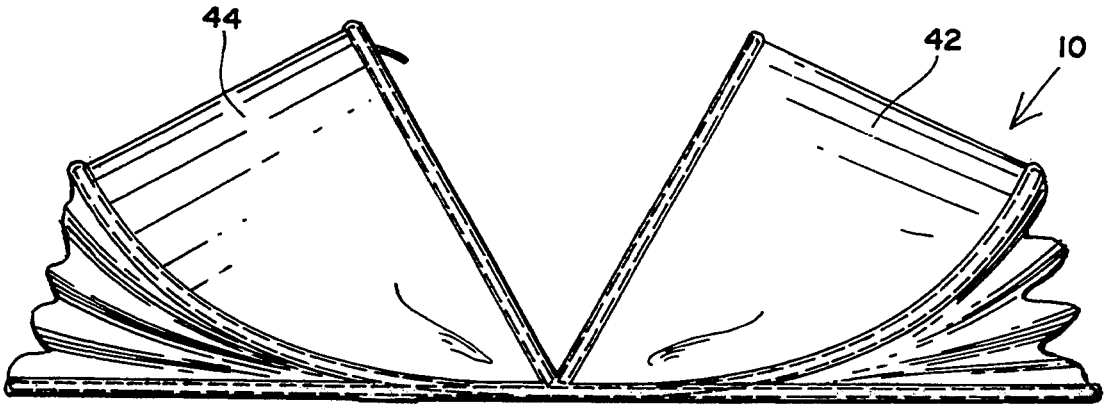
FIG. 5 is a side view of the blind of FIG. 3 showing partial opening of the transverse loop halves.
Figure 6:
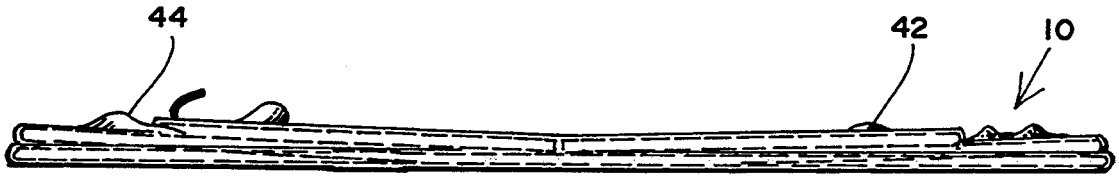
FIG. 6 is a side view of the blind showing the same in a fully open configuration.

FIG.4 shows a strap 46 attached between halves 42 and 44. One end 48 of strap 46 is attached such as by sewing to half 42; while, the other end 52 of strap 46 is attached to half 44. A quick disconnect type of buckle 54 connects the sections of strap 46 together. When buckle 54 is connected, the halves 42 and 44 remain in the overlapped position shown in FIG. 4 and the blind 10 is in the erected position shown in FIG. 3. When buckle 54 is disconnected, the spring tension in loop 24 causes halves 42 and 44 to rapidly move away from each other and blind 10 begins to open as schematically shown in FIG. 5. Almost immediately thereafter, the blind fully opens, as schematically shown in FIG. 6, with each half 42 and 44 of transverse loop 24 coming to rest against respective portions of loop 22 which is already on the ground. It may be readily envisioned that the opening of blind 10 is initiated by a hunter from inside of the blind by simply disconnecting buckle 54. The spring tension in rods 16, 32 and 34 does the rest. It is to be noted that this simple procedure by a hunter does not require putting down and picking up a loaded gun. The invention herein is not to be limited to the use of a strap and buckle, obvious equivalents such as velcro fastener may also be used.

Figure 7:
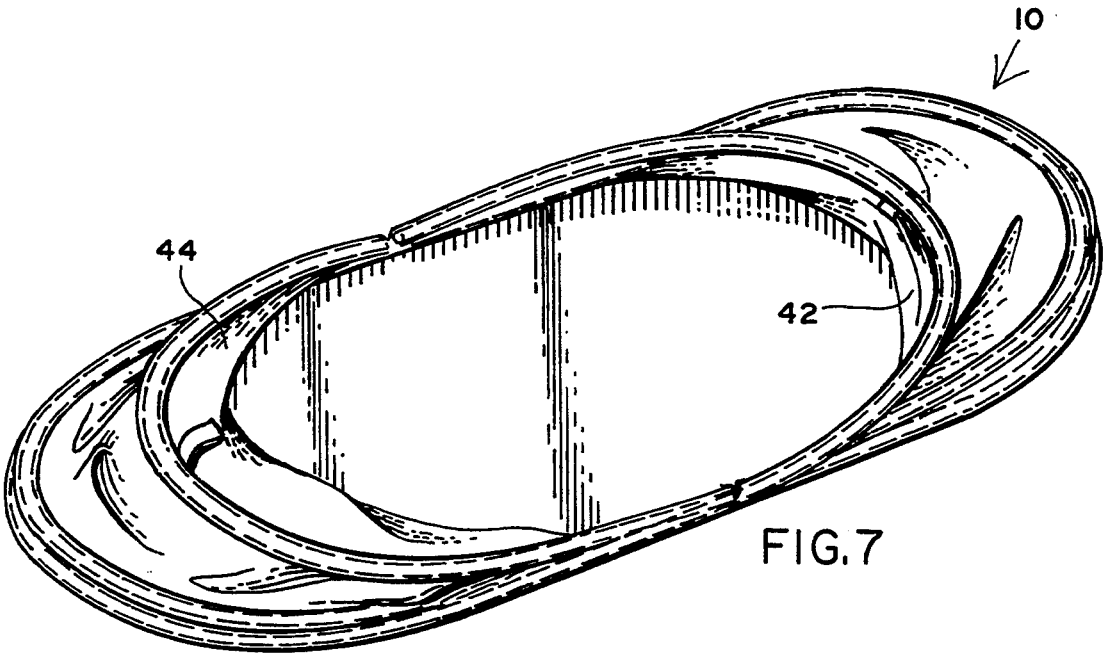
FIG. 7 is an isometric view of the blind in an open configuration.

A top view of the ample opening 56 provided by blind 10 is shown in FIG. 7. Moreover, since halves 42 and 44 completely fall away from each other, a hunter has absolutely no obstructions in his way when he takes aim and shoots. This aspect is extremely beneficial from both a convenience and a safety standpoint.

The blind fabric 26 may be of a screen or see through type having camouflage coloring. This allows a hunter to have three hundred and sixty degrees of visibility from within the blind 10 and yet provides him with hunting invisibility. Blind 10 may or may not be provided with a floor. Without a floor, the blind 10 may be used with a boat. With the use of a tent fly, the blind 10 may be used for sleeping or other tent living purposes.

The divided halves of the transverse loop may also be used with a self erecting structure having two or more independent loops which are attached to each other by appropriate connectors located at opposite locations of the transverse loop at the end of the longitudinal axis thereof.

While the invention has been described, disclosed, illustrated and shown in certain terms or certain embodiments or modifications which it has assumed in practice, the scope of the invention is not intended to be limited nor should it be deemed to be limited thereby and such other modifications or embodiments as may be suggested by the teachings herein are particularly reserved especially as they fall within the breath and scope of the claims here appended.

We claim as our invention:

1. A self erecting hunting blind comprising one or more first elastic rod means joined at ends thereof by one or more connectors for forming a frame comprising a first lower loop and a second upper loop, said second loop arranged transverse to said first loop, a fabric covering configured to fit over said frame, one or more first sleeve means provided in said fabric covering for fitting therein said one or more first rod means and for constraining said rod means into said lower and upper loop configurations and whereby said one or more first elastic rod means and said one or more first sleeve means form said fabric into a taut, self erecting, hunting blind structure, the fabric of said transverse loop being divided into two longitudinal halves, and means for releasably attaching together said two halves.

2. The hunting blind apparatus of claim 1 including second and third rod means for supporting adjoining edges of said transverse loop halves.

3. The hunting blind apparatus of claim 2 including second and third sleeve means in said fabric halves fitting therein said second and third rod means.

4. The hunting blind apparatus of claim 1 wherein said releasing means comprises a strap having two ends one of which is attached to one of said transverse loop halves, and the other end being attached to the other of said transverse loop halves.

5. The hunting blind apparatus of claim 4 including buckle connecting halves of said step.

6. The hunting blind apparatus of claim 4 wherein said buckle is a quick release buckle.

7. The hunting blind apparatus of claim 1 wherein said blind fabric comprises a see through fabric.

8. The hunting blind apparatus of claim 1 wherein said blind fabric is colored to blend into the environment surrounding said hunting blind.

9. A self erecting hunting blind comprising first elastic rod means forming a first lower loop, second elastic rod means forming a second loop, said second loop arranged transverse to said first loop, said first and second loops being connected together at a location at opposite longitudinal ends of said transverse loop, a fabric configured to fit over said first and second loops, said fabric over said transverse loop being divided into longitudinal halves, and means for releasably attaching together said transverse loop fabric halves.

10. A self erecting hunting blind comprising a single elastic rod means joined at ends thereof by a single connector for forming an endless frame comprising a first lower loop and a second upper loop, said second upper loop arranged transverse to said first loop, a fabric covering configured to fit over said first and second loops, sleeve means provided in said fabric covering for fitting therein said rod means and for constraining said rod means into said lower and upper loops, said fabric over said second loop being divided into two halves, and means for releasably attaching together said halves of said fabric over said second loop.

* * * * *